US007663651B2

(12) United States Patent
Itoh et al.

(10) Patent No.: US 7,663,651 B2
(45) Date of Patent: Feb. 16, 2010

(54) IMAGE DISPLAY METHOD AND APPARATUS

(75) Inventors: Goh Itoh, Tokyo (JP); Kazuyasu Ohwaki, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 698 days.

(21) Appl. No.: 11/457,977

(22) Filed: Jul. 17, 2006

(65) Prior Publication Data

US 2007/0057960 A1 Mar. 15, 2007

(30) Foreign Application Priority Data

Sep. 15, 2005 (JP) ..... 2005-268982

(51) Int. Cl.
*G09G 5/02* (2006.01)

(52) U.S. Cl. ..... 345/698; 345/55; 382/279

(58) Field of Classification Search ..... 345/55, 345/589, 667, 670, 698, 699; 382/279, 298, 382/299, 300; 204/694
See application file for complete search history.

(56) References Cited

U.S. PATENT DOCUMENTS 5,995,070 A * 11/1999 Kitada ..... 345/83
6,252,989 B1 * 6/2001 Geisler et al. ..... 382/232
6,340,994 B1 * 1/2002 Margulis et al. ..... 348/625
6,807,319 B2 * 10/2004 Kovvuri et al. ..... 382/275
2004/0183754 A1 9/2004 Tokimoto et al.
2004/0264798 A1 * 12/2004 Daly ..... 382/263
2005/0068335 A1 * 3/2005 Tretter et al. ..... 345/619

FOREIGN PATENT DOCUMENTS

JP 3396215 2/2003

* cited by examiner

*Primary Examiner*—Richard Hjerpe
*Assistant Examiner*—Carolyn R Edwards
(74) *Attorney, Agent, or Firm*—Oblon, Spivak, McClelland, Maier & Neustadt, L.L.P.

(57) ABSTRACT

An image has pixels arranged in ((M lines)×(N columns)) each pixel having color information. A display has elements arranged in ((P lines)×(Q columns), 1<P<M, 1<Q<N). The image is separated into a first component and a second component based on a threshold. The first component has a spatial frequency not lower than the threshold. The second component has a spatial frequency lower than the threshold. The threshold is a ratio of the number of the elements to the number of the pixels. A plurality of first display components is generated from the first component by filter processing using a plurality of filters. A second display component is generated from the second component by filter processing. A plurality of sub-field images is generated by composing each of the plurality of first display components with the second display component. Each element of the display is driven using the color information of a pixel corresponding to the element in pixels of each of the plurality of sub-field images.

19 Claims, 15 Drawing Sheets

601

| | | |
|---|---|---|
| 0.04 | 0.04 | 0.04 |
| 0.04 | 0.2 | 0.2 |
| 0.04 | 0.2 | 0.2 |

FIG. 6A

602

| | | |
|---|---|---|
| 0.04 | 0.2 | 0.2 |
| 0.04 | 0.2 | 0.2 |
| 0.04 | 0.04 | 0.04 |

FIG. 6B

603

| | | |
|---|---|---|
| 0.2 | 0.2 | 0.04 |
| 0.2 | 0.2 | 0.04 |
| 0.04 | 0.04 | 0.04 |

FIG. 6C

604

| | | |
|---|---|---|
| 0.04 | 0.04 | 0.04 |
| 0.2 | 0.2 | 0.04 |
| 0.2 | 0.2 | 0.04 |

FIG. 6D

FIG. 7A

| | | | |
|---|---|---|---|
| 1/9 | 1/9 | 1/9 | 0 |
| 1/9 | 1/9 | 1/9 | 0 |
| 1/9 | 1/9 | 1/9 | 0 |
| 0 | 0 | 0 | 0 |

701

FIG. 7B

| | | | |
|---|---|---|---|
| 0 | 0 | 0 | 0 |
| 1/9 | 1/9 | 1/9 | 0 |
| 1/9 | 1/9 | 1/9 | 0 |
| 1/9 | 1/9 | 1/9 | 0 |

702

FIG. 7C

| | | | |
|---|---|---|---|
| 0 | 0 | 0 | 0 |
| 0 | 1/9 | 1/9 | 1/9 |
| 0 | 1/9 | 1/9 | 1/9 |
| 0 | 1/9 | 1/9 | 1/9 |

703

FIG. 7D

| | | | |
|---|---|---|---|
| 0 | 1/9 | 1/9 | 1/9 |
| 0 | 1/9 | 1/9 | 1/9 |
| 0 | 1/9 | 1/9 | 1/9 |
| 0 | 0 | 0 | 0 |

704

FIG. 8A

| | |
|---|---|
| 1 | 0 |
| 0 | 0 |

801

FIG. 8B

| | |
|---|---|
| 0 | 0 |
| 1 | 0 |

802

FIG. 8C

| | |
|---|---|
| 0 | 0 |
| 0 | 1 |

803

FIG. 8D

| | |
|---|---|
| 0 | 1 |
| 0 | 0 |

804

IMAGE DISPLAY METHOD AND APPARATUS

CROSS-REFERENCE TO RELATED APPLICATIONS

This application is based upon and claims the benefit of priority from prior Japanese Patent Application No. 2005-268982, filed on Sep. 15, 2005; the entire contents of which are incorporated herein by reference.

FIELD OF THE INVENTION

The present invention relates to an image display method and an apparatus for down-sampling an input image signal having a spatial resolution higher than a spatial resolution of a dot matrix type display.

BACKGROUND OF THE INVENTION

In a large-sized LED (light emitting diode) display apparatus, a plurality of LEDs each emitting a primary color (red, green, blue) are arranged in dot matrix format. Each element on this display apparatus is one LED emitting any one color of red, green, and blue. However, an element size of one LED is large. Even if the display apparatus is large-sized, high definition of the display cannot be realized, and the spatial resolution is not high. Accordingly, in case of inputting an image signal having a resolution higher than a resolution of the display apparatus, reduction or down-sampling of the image signal is necessary. In this case, image quality falls because of flicker caused by aliasing. In order to remove the flicker, the image signal is generally processed through a low-pass filter as a pre-filter. However, if a high region of the image signal is reduced too much, the image somewhat blurs and visibility falls. Furthermore, the spatial resolution is not originally so high. Accordingly, if the aliasing is suppressed by the low-pass filter, the image is apt to blur.

On the other hand, in the LED display apparatus, a response characteristic of a LED element is very quick. Furthermore, in order to maintain brightness, the same image is normally displayed by refreshing a plurality of times. For example, a frame frequency of the input image signal is normally 60 Hz while a field frequency of the LED display apparatus is 1000 Hz. In this way, low resolution and high field frequency are characteristic of the LED display apparatus.

A high resolution method of the LED display apparatus is disclosed in Japanese Patent No. 3396215. In this method, each lamp (LED element) of the display apparatus corresponds to each pixel of image data of one frame. The one frame is divided into four fields (Hereinafter, sub-field) and displayed.

In a first sub-field, each lamp is driven by the same color component as the lamp in color components (red, green, blue) of a pixel corresponding to the lamp. In a second sub-field, each lamp is driven by the same color component as the lamp in color components of a pixel to the right of the corresponding pixel. In a third sub-field, each lamp is driven by the same color component as the lamp in color components of a pixel to the right and below the corresponding pixel. In a fourth sub-field, each lamp is driven by the same color component as the lamp in color components of a pixel below the corresponding pixel.

Briefly, in the method of this publication, the image data is quickly displayed by sub-sampling in time series. As a result, all the image data is displayed.

However, in this method, image data generated by partially omitting pixels of an original image is displayed as an image of each sub-field. Accordingly, the image of each sub-field includes a flicker and a color smear because of aliasing. As a result, in an image displayed for one frame period, the image quality falls because of aliasing.

SUMMARY OF THE INVENTION

The present invention is directed to an image display method and an apparatus for clearly displaying an image by suppressing aliasing in case of the image having a spatial resolution higher than a spatial resolution of the dot matrix type display.

According to an aspect of the present invention, there is provided a method for displaying an image on a display apparatus of dot matrix type, the image having pixels arranged in ((M lines)×(N columns)), each pixel having color information, the display apparatus having elements arranged in ((P lines)×(Q columns), $1<P<M$, $1<Q<N$), comprising: separating the image into a first component and a second component based on a threshold, the first component having a spatial frequency not lower than the threshold, the second component having a spatial frequency lower than the threshold, the threshold being a ratio of the number of the elements to the number of the pixels; generating a plurality of first display components from the first component by first filter processing using a plurality of filters; generating a second display component from the second component by second filter processing; generating a plurality of sub-field images by composing each of the plurality of first display components with the second display component; and driving each element of the display apparatus using the color information of a pixel corresponding to the element in pixels of each of the plurality of sub-field images.

According to another aspect of the present invention, there is also provided an apparatus for displaying an image on a display of dot matrix type, the image having pixels arranged in ((M lines)×(N columns)), each pixel having color information, the display having elements arranged in ((P lines)×(Q columns), $1<P<M$, $1<Q<N$), comprising: a separation unit configured to separate the image into a first component and a second component based on a threshold, the first component having a spatial frequency not lower than the threshold, the second component having a spatial frequency lower than the threshold, the threshold being a ratio of the number of the elements to the number of the pixels; a first filter processing unit configured to generate a plurality of first display components from the first component by first filter processing using a plurality of filters; a second filter processing unit configured to generate a second display component from the second component by second filter processing; a composition unit configured to generate a plurality of sub-field images by composing each of the plurality of first display components with the second display component; and a driving unit configured to drive each element of the display using the color information of a pixel corresponding to the element in pixels of each of the plurality of sub-field images.

According to still another aspect of the present invention, there is also provided a computer program product, comprising: a computer readable program code embodied in said product for causing a computer to display an image on a display apparatus of dot matrix type, the image having pixels arranged in ((M lines)×(N columns)), each pixel having color information, the display apparatus having elements arranged in ((P lines)×(Q columns), $1<P<M$, $1<Q<N$), said computer readable program code comprising: a first program code to separate the image into a first component and a second component based on a threshold, the first component having a spatial frequency not lower than the threshold, the second component having a spatial frequency lower than the threshold, the threshold being a ratio of the number of the elements to the number of the pixels; a second program code to generate a plurality of first display components from the first component by first filter processing using a plurality of filters; a third program code to generate a second display component from the second component by second filter processing; a fourth program code to generate a plurality of sub-field images by composing each of the plurality of first display components with the second display component; and a fifth program code to drive each element of the display apparatus using the color information of a pixel corresponding to the element in pixels of each of the plurality of sub-field images.

BRIEF DESCRIPTION OF THE DRAWINGS

FIGS. 6A, 6B, 6C, and 6D are schematic diagrams of first filter coefficients of a filter processing unit in FIG. 1.

FIGS. 7A, 7B, 7C, and 7D are schematic diagrams of second filter coefficients of the filter processing unit in FIG. 1.

FIGS. 8A, 8B, 8C, and 8D are schematic diagrams of third filter coefficients of the filter processing unit in FIG. 1.

DETAILED DESCRIPTION OF THE EMBODIMENTS

Figure 1:
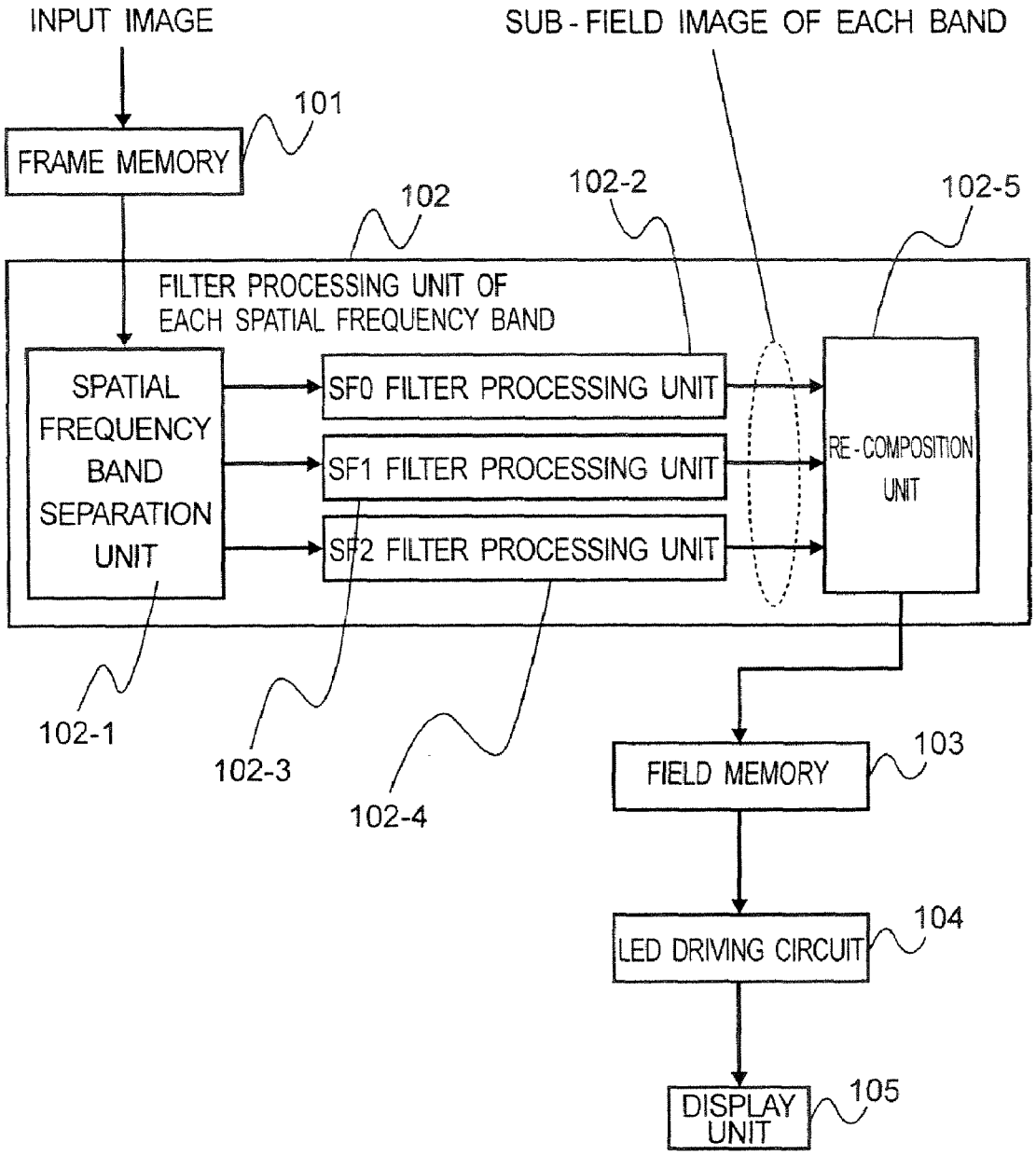
FIG. 1 is a block diagram of the dot matrix type display apparatus according to a first embodiment.

Hereinafter, various embodiments of the present invention will be explained by referring to the drawings. The present invention is not limited to the following embodiments.

A dot matrix type display apparatus of a first embodiment of the present invention is explained using a LED display apparatus as a representative example. FIG. 1 is a block diagram of an image processing system of the first embodiment.

In the image processing system shown in FIG. 1, a frame memory 101 stores an input image. A filter processing unit 102 of each spatial frequency band (each band of a spatial frequency) executes filter processing of the input image based on the band, and generates a field image. A field memory 103 stores the field image. The spatial frequency means a resolution of each component (such as an edge region, a bright region, a dark region, a blur region) of the image, i.e., the number of pixels by which black and white pixels are inverted in the component.

Furthermore, in the image processing system, a display unit 105 has a plurality of LED elements arranged in matrix format. A LED driving circuit 104 drives each LED element of the display unit 105 to emit using the field image stored in the field memory 103.

In the filter processing unit 102 of each spatial frequency band, a spatial frequency band separation unit 102-1 separates the input image into a plurality of spatial frequency band component. A SF0 filter processing unit 102-2, a SF1 filter processing unit 102-3 and a SF2 filter processing unit 102-4 executes filter processing of each spatial frequency band. A re-composition unit 102-5 composes one sub-field image from a plurality of sub-field images of each band (processed by the processing units 102-2, 102-3, 102-4).

The filter processing unit 102 separates the input image into three spatial frequency bands SF0, SF1 and SF2. A recomposed sub-field image is stored in the field memory 103. The sub-field image represents an image divided from one frame image along time direction. One frame image is generated by adding the sub-field images together.

Figure 2:
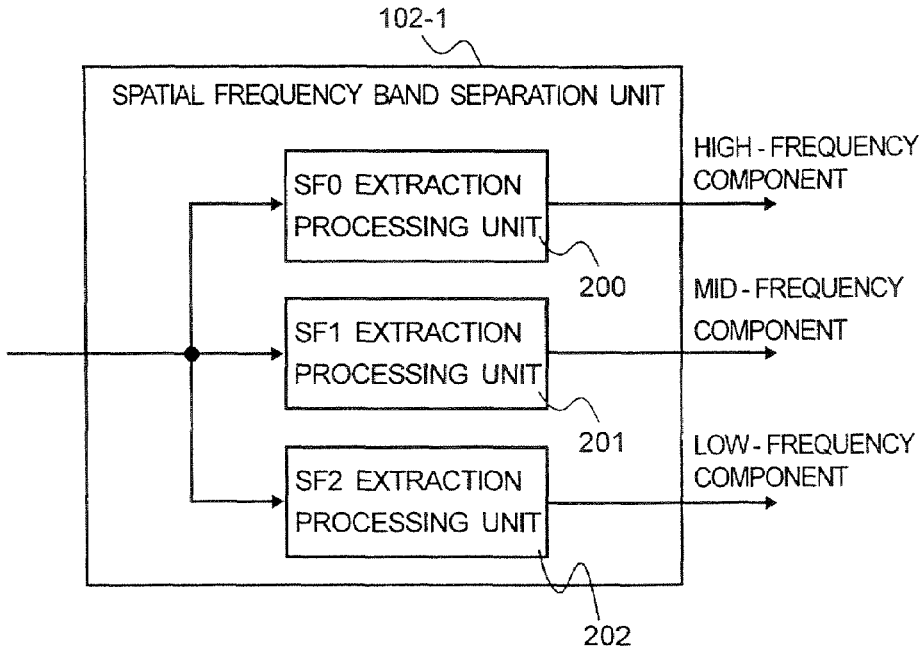
FIG. 2 is a block diagram of a spatial frequency band separation unit in FIG. 1.

FIG. 2 is a block diagram of the spatial frequency band separation unit 102-1. In the spatial frequency band separation unit 102-1, a SF0 extraction processing unit 200 extracts a component SF0 having a high-frequency band (high-resolution component) from the input image. A SF1 extraction processing unit 201 extracts a component SF1 having a mid-frequency band (mid-resolution component) from the input image. A SF2 extraction processing unit 202 extracts a component SF2 having a low-frequency band (low-resolution component) from the input image.

In FIG. 2, three kinds of filters (processing units 200, 201, 202) are applied to the input image in parallel. Accordingly, in order not to drop a sum of intensity of each separation image from a spatial frequency component of the input image, filter coefficient needs be adjusted.

Figure 3:
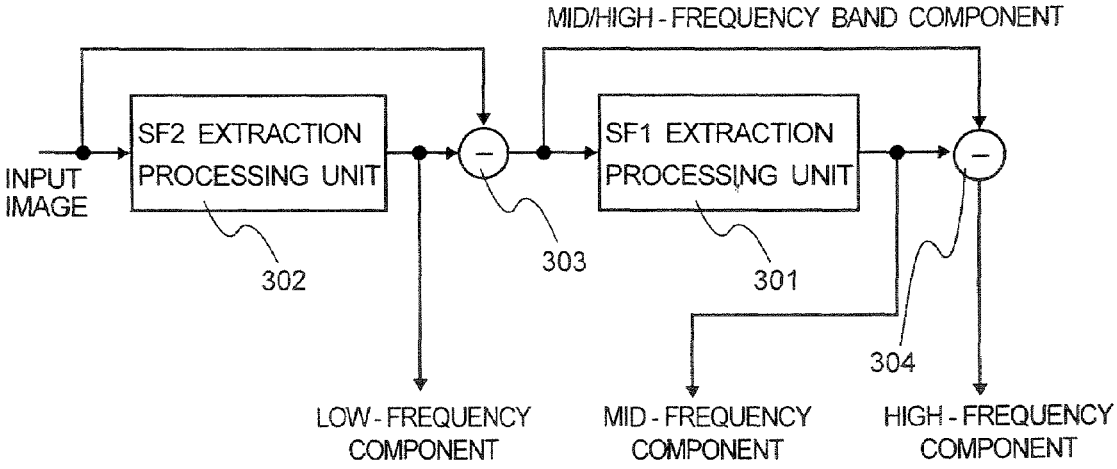
FIG. 3 is another block of the spatial frequency band separation unit in FIG. 1.

FIG. 3 is a block diagram of modification of the spatial frequency band separation unit 102-1. In FIG. 3, a SF2 extraction processing unit 302 extracts a component SF2 having a low-frequency band from the input image. A subtractor 303 outputs mid/high-frequency bands by subtracting the component SF2 from the input image. A SF1 extraction processing unit 301 extracts a component SF1 having a mid-frequency band from the mid/high-frequency bands. A subtractor 304 outputs a component SF0 having a high-frequency band by subtracting the component SF1 from the mid/high-frequency bands. In the construction of FIG. 3, above-mentioned problem for the sum of intensity does not occur.

Figure 4A:
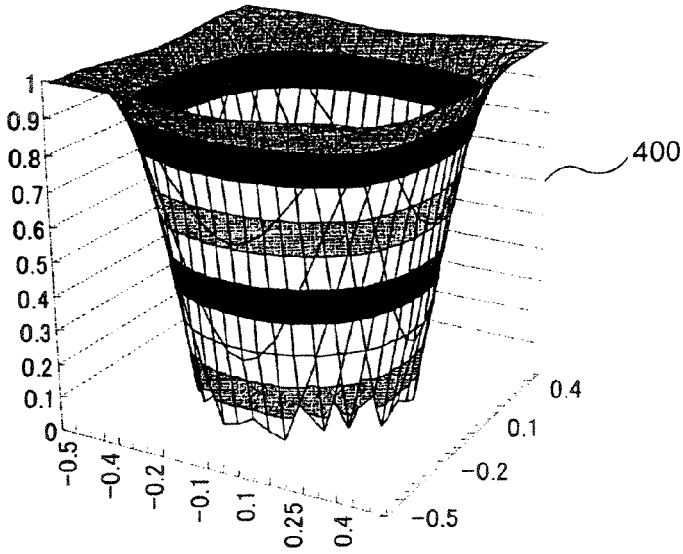
FIGS 4A, 4B, and 4C are schematic diagrams of characteristics of spatial frequency band extraction filters according to the first embodiment.
Figure 4B:
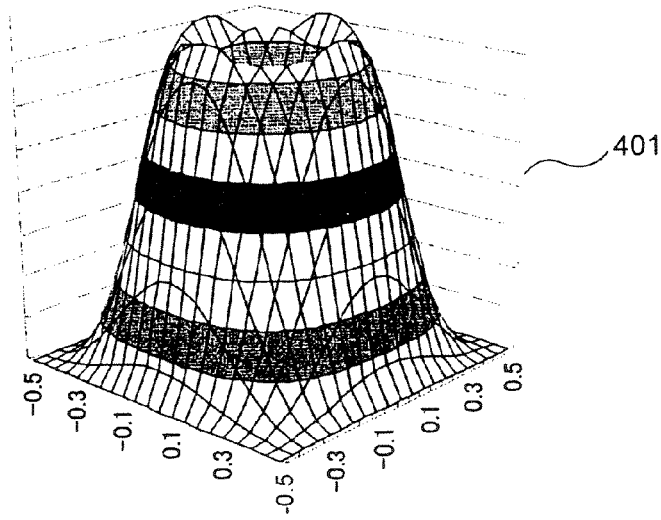
Figure 4C:
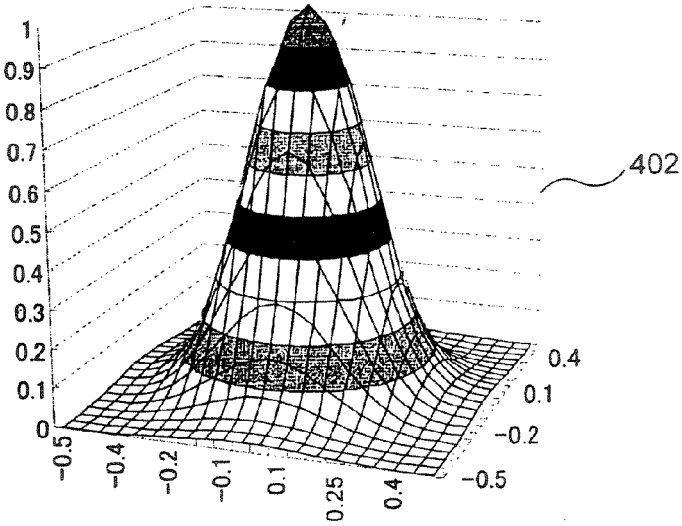
Figure 5A:
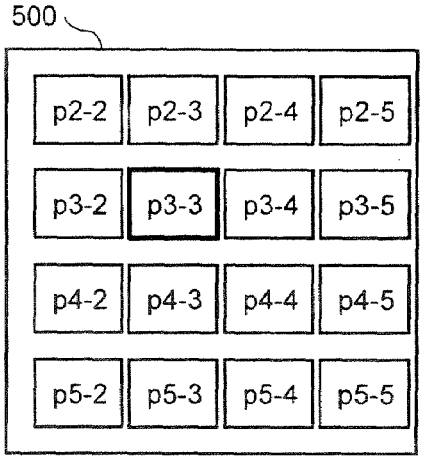
FIGS. 5A, SB, 5C, 5D, and 5E are schematic diagrams of components of image data according to the first embodiment.
Figure 5B:
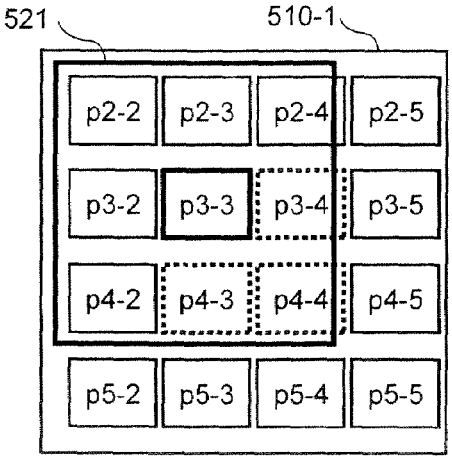
Figure 5C:
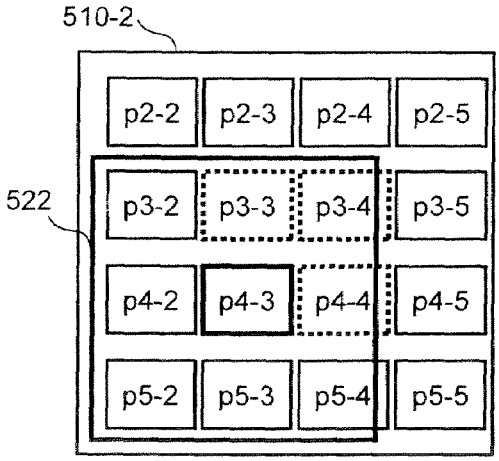
Figure 5D:
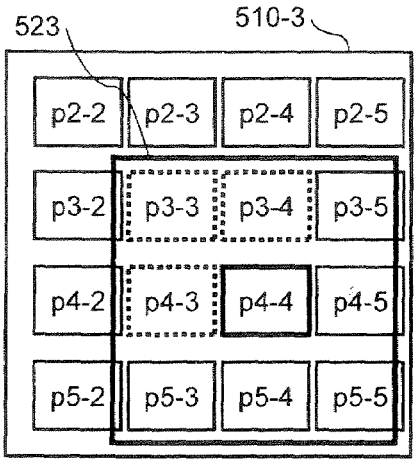
Figure 5E:
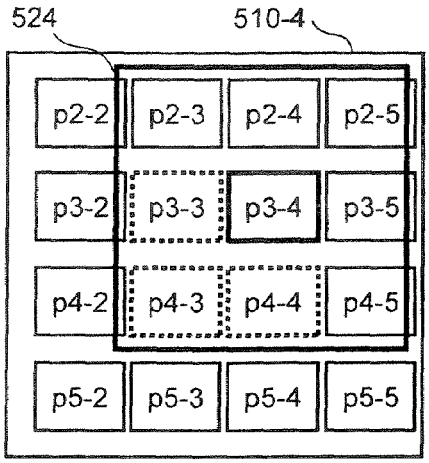

FIGS. 4A, 4B, and 4C are schematic diagrams of frequency characteristics of filters used by the SF0 extraction processing unit 200, the SF1 extraction processing unit 201, and the SF2 extraction processing unit 202. A frequency characteristic 400 corresponds to a filter used by the SF0 extraction processing unit 200. A frequency characteristic 401 corresponds to a filter used by the SF1 extraction processing unit 201. A frequency characteristic 402 corresponds to a filter used by the SF2 extraction processing unit 202.

In graph of each frequency characteristic of FIGS. 4A~4C, a coordinate (0,0) is DC (direct current) component. The larger the absolute value of a numerical value of a coordinate axis is, the higher a spatial frequency along a horizontal/vertical axis is. This spatial frequency is a spatial frequency of the input image. For example, a numerical value "0.25" represents an image having a resolution that black and white pixels are inverted by four pixels. A numerical value "0.5" represents an image having a resolution that black and white pixels are inverted by two pixels.

Briefly, the frequency characteristic 400 is a characteristic that a component of high-frequency passes. The frequency characteristic 401 is a characteristic that a component of mid-frequency passes. The frequency characteristic 402 is a characteristic that a component of low-frequency passes.

On the other hand, in case of dividing the input image into components SF1, SF1 and SF2, a band of spatial frequency is determined based on a spatial frequency component DF displayable on the dot matrix type display apparatus. The spatial frequency component DF depends on a resolution of the dot matrix type display apparatus and a resolution of the input image. In case of displaying an input image having pixels arranged in ((M lines)×(N columns)) on the display apparatus having elements arranged in ((P lines)×(Q columns), $1<P<M$, $1<Q<N$), a displayable spatial frequency is reduced by P/M along the vertical direction and by Q/N along the horizontal direction. Accordingly, the spatial frequency component DF need be reduced by P/M along the vertical direction and by Q/N along the horizontal direction.

For example, in case of displaying an input image having pixels arranged in ((480 lines)×(640 columns)) on the display apparatus having elements arranged in ((240 lines)×(320 columns), a resolution of the display apparatus is respectively reduced by ½ along the vertical direction and the horizontal direction in comparison with a resolution of the input image. As a result, a component of spatial frequency "0.25" of the input image can be displayed by two pixels on the display apparatus. However, a component of spatial frequency "0.5" of the input image cannot be displayed because this component corresponds to one pixel on the display apparatus. This component is an alias component. Accordingly, in this case, a maximum spatial frequency DF1 is "0.5" in FIGS. 4A~4C.

In the same way, in case of displaying an input image having pixels arranged in ((480 lines)×(640 columns)) on the display apparatus having elements arranged in ((120 lines)×(160 columns), the maximum spatial frequency DF1 is 0.25 (black and white pixels are inverted by four pixels on the input image) in FIGS. 4A~4C.

Various determination methods are considered for a component SFi having a mid spatial frequency. For example, the component SFi may be 1/Z (Z: positive integer) of a component having a high spatial frequency. In case of "Z=2", SFi is ½. In FIGS. 4A~4C, a spatial frequency 0.25 (resolution that black and white pixels are inverted by four pixels) corresponds to a component SF1. In the same way, a component SF2 corresponds to a spatial frequency 0.125 (resolution that black and white pixels are inverted by eight pixels), and a component SF3 corresponds to a spatial frequency 0.0625 (resolution that black and white pixels are inverted by sixteen pixels).

In FIG. 1, the input image is divided into three components SF0, SF1, and SF2. A mid-frequency band is a component SF1, and a low-frequency band is a component SF2. In this case, the low-frequency band may be the remaining component (not included in the high-frequency band and the mid-frequency band).

In above-mentioned method, a component having a high-frequency is first determined. Conversely, a low-frequency component may be determined. For example, in case of dividing an image into three components as shown in FIG. 1, the low-frequency component is extracted from a direct current component to a spatial frequency 0.125, a mid-frequency component is extracted from the spatial frequency 0.125 to a spatial frequency 0.25, and a high-frequency component is the remaining component.

Furthermore, actually, a filter able to perfectly divide the image by a frequency may not exist. Accordingly, a spatial frequency component can be clarified by a central band. For example, in filter characteristic of FIGS. 4A~4C, a mid-frequency component is defined as a component of spatial frequency having a fixed width centering around 0.25. A high-frequency component is defined as a component of spatial frequency higher than the mid-frequency component. A low-frequency component is defined as a component of spatial frequency lower than the mid-frequency component.

Next, in FIG. 1, each filtering method of the SF0 filter processing unit 102-2, the SF1 filter processing unit 102-3, and the SF2 filter processing unit 102-4 is explained.

A component SF0 of high-frequency band is input to the SF0 filter processing unit 102-2. This component is an alias component which cannot be displayed on the dot matrix type display apparatus. Accordingly, this component should be removed or converted to lower frequency component.

In the SF0 filter processing unit 102-2, four sub-field images are generated by filter processing with four filter coefficients (changed along time direction). Briefly, the SF0 filter processing unit 102-2 generates four sub-field images from one input image by applying four filters (each having a different filter coefficient). Even if a region of pixels applied by a filter (having a fixed filter coefficient) is changed, the same result is obtained.

FIGS. 5A~5E are schematic diagrams to explain filter processing of the SF0 filter processing unit 102-2. In this case, four sub-field images are generated from a frame image 500.

For example, on the dot matrix type display apparatus, as for an element corresponding to a pixel P3-3 on the frame image 500, pixel data of each sub-field image is calculated as follows.

(Generation of a First Sub-field Image: 510-1)

A first filter of a number of taps "3×3" is convoluted onto image data of pixels "3×3" (P2-2, P2-3, P2-4, P3-2, P3-3, P3-4, P4-2, P4-3, P4-4) centering around P3-3.

(Generation of a Second Sub-field Image: 510-2)

A second filter of a number of taps "3×3" is convoluted onto image data of pixels "3×3" (P3-2, P3-3, P3-4, P4-2, P4-3, P4-4, P5-2, P5-3, P5-4) centering around P4-3.

(Generation of a Third Sub-field Image: 510-3)

A third filter of a number of taps "3×3" is convoluted onto image data of pixels "3×3" (P3-3, P3-4, P3-5, P4-3, P4-4, P4-5, P5-3, P5-4, P5-5) centering around P4-4.

(Generation of a Fourth Sub-field Image: 510-4)

A fourth filter of a number of taps "3×3" is convoluted onto image data of pixels "3×3" (P2-3, P2-4, P2-5, P3-3, P3-4, P3-5, P4-3, P4-4, P4-5) centering around P3-4.

FIGS. 6A~6E show examples of the first, second, third, and fourth filters. The first filter is a filter 601; the second filter is a filter 602; the third filter is a filter 603; and the fourth filter is a filter 604.

The filter 601 is used for the first sub-field image. A coefficient 0.2 is used for pixels p3-3, p4-3, p4-4, p3-4. A coefficient 0.04 is used for other pixels.

The filter 602 is used for the second sub-field image. A coefficient 0.2 is used for pixels P3-3, P4-3, P4-4, P3-4. A coefficient 0.04 is used for other pixels.

The filter 603 is used for the third sub-field image. A coefficient 0.2 is used for pixels P3-3, P4-3, P4-4, P3-4. A coefficient 0.04 is used for other pixels.

The filter 604 is used for the fourth sub-field image. A coefficient 0.2 is used for pixels P3-3, P4-3, P4-4, P3-4. A coefficient 0.04 is used for other pixels.

Briefly, in case of using filters 601, 602, 603, and 604 shown in FIGS. 6A~6C, coefficient of pixels P3-3, P4-3, P4-4 and P3-4 are the same among the sub-field images. The SF0 filter processing unit 102-2 may use such filters.

FIGS. 7A, 7B, 7C, and 7D show examples of another filter. In case of using this filter, the SF0 filter processing unit 102-2 executes filter processing by convolution between image data of pixels "4×4" and the filter of a number of taps "4×4". In case of using a filter of FIGS. 6A~6C, a center pixel of pixels "3×3" on the image data applied by the filter is changed by each sub-field. However, in FIGS. 7A~7C, by changing distribution of coefficients (not equal to "0"), the same effect as above-mentioned change of the center pixel is obtained.

In FIGS. 5A~5E and FIGS. 7A~7D, examples are explained as follows.

(Generation of a First Sub-field Image: 510-1)

A filter 701 is used for sixteen pixels from P2-2 to P5-5. Coefficients (not equal to "0") of the filter 701 corresponds to "3×3" pixels (P2-2, P2-3, P2-4, P3-2, P3-3, P3-4, P4-2, P4-3, P4-4) centering around P3-3.

(Generation of a Second Sub-Field Image: 510-2)

A filter 702 is used for sixteen pixels from P2-2 to P5-5. Coefficients (not equal to "0") of the filter 702 corresponds to "3×3" pixels (P3-2, P3-3, P3-4, P4-2, P4-3, P4-4, P5-2, P5-3, P5-4) centering around P4-3.

(Generation of a Third Sub-field Image: 510-3)

A filter 703 is used for sixteen pixels from P2-2 to P5-5. Coefficients (not equal to "0") of the filter 703 corresponds to "3×3" pixels (P3-3, P3-4, P3-5, P4-3, P4-4, P4-5, P5-3, P5-4, P5-5) centering around P4-4.

(Generation of a Fourth Sub-field Image: 510-4)

A filter 704 is used for sixteen pixels from P2-2 to P5-5. Coefficients (not equal to "0") of the filter 704 corresponds to "3×3" pixels (P2-3, P2-4, P2-5, P3-3, P3-4, P3-5, P4-3, P4-4, P4-5) centering around P3-4.

FIGS. 8A~8D show simple examples to change distribution of coefficients (not equal to "0"). By using filters 801, 802, 803, and 804, a number of taps "2×2" is convoluted with pixels "2×2" of image data. This filter realizes the same processing as a sub-sampling processing.

A component SF1 of mid-frequency band is input to the SF1 filter processing unit 102-3. The component SF1 is the highest frequency band displayable on the dot matrix type display apparatus. Briefly, the component SF1 contributes to sharpness (resolution) of the image. Accordingly, filter processing to reduce a band corresponding to the component SF1 (such as a low-pass filter or a band elimination type filter) is not desirable because resolution of the image falls. Conversely, filter processing to raise contrast (such as edge emphasis) is useful.

A component SF2 of low-frequency band is input to the SF2 filter processing unit 102-4. This component contributes to brightness of the image because a direct current component is included. Accordingly, the component SF2 may be directly output to the re-composition unit 102-5 without filter processing.

Figure 9A:
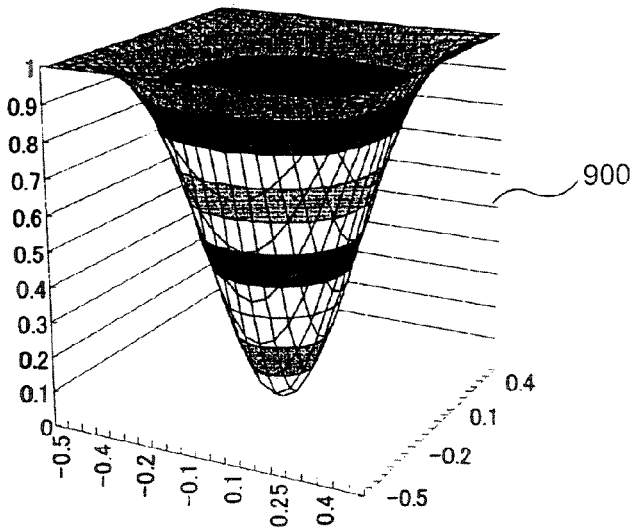
FIGS. 9A, 9B, and 9C are schematic diagrams of other characteristics of spatial frequency band extraction filters according to the first embodiment.
Figure 9B:
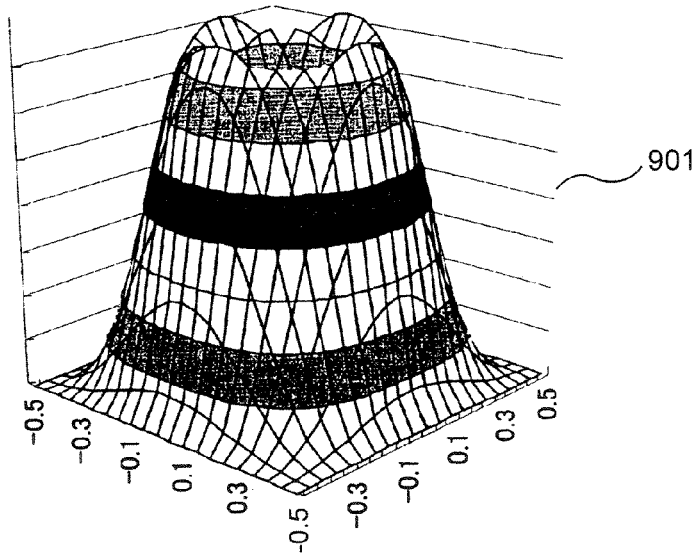
Figure 9C:
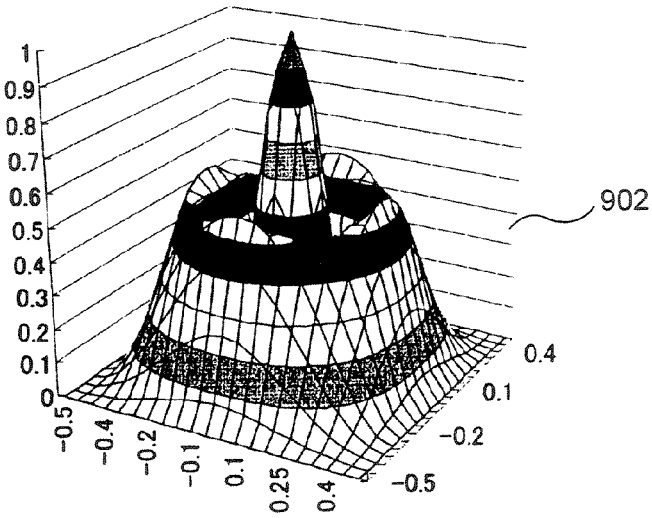

Alternatively, in order to adjust the brightness of the image, a filter coefficient of the SF2 filter processing unit 102-4 may be calculated using filter coefficients of the SF0 filter processing unit 102-2 and the SF1 filter processing unit 102-3. FIGS. 9A~9C show examples of frequency characteristics of this filter.

In FIGS. 9A~9C, a frequency characteristic 900 is a characteristic of a filter used by the SF0 filter processing unit 102-2. A frequency characteristic 901 is a characteristic of a filter used by the SF1 filter processing unit 102-3. A frequency characteristic 902 is a characteristic of a filter used by the SF2 filter processing unit 102-4.

The SF2 filter processing unit 102-4 corrects brightness using a filter of frequency characteristic 902. A coefficient of a filter used by the SF2 filter processing unit 102-4 is calculated using coefficients of filters used by the SF0 filter processing unit 102-2 and the SF1 filter processing unit 102-3.

As an example of another filter, in order to suppress blur over the entire image and thickness of a line segment, a filter coefficient of high-frequency band may be constant irrelevant to time.

Next, an image generation method of the dot matrix type display apparatus of the second embodiment is explained. In the same way as in the first embodiment, the dot matrix type display apparatus of the second embodiment includes the filter processing unit 102 of each spatial frequency band.

In the second embodiment, an input image of one frame is divided into four sub-field image. Pixels "(4 lines)×(4 columns)" included in the image signal "(480 lines)×(640 columns)" are converted to one element included in elements "(240 lines)×(320 columns)" of the dot matrix type display apparatus.

In the second embodiment, as for a component SF0 of high-frequency band, four kernels U1, U2, U3, and U4 each having a number of taps "4×4" are prepared as filter processing of SF0. In order to generate the first sub-field image, a kernel U1 is convoluted to pixels "(4 lines)×(4 columns)" of the input image. In order to generate the second sub-field image, a kernel U2 is convoluted to pixels "(4 lines)×(4 columns)" of the input image. In order to generate the third sub-field image, a kernel U3 is convoluted to pixels "(4 lines)×(4 columns)" of the input image. In order to generate the fourth sub-field image, a kernel U4 is convoluted to pixels "(4 lines)×(4 columns)" of the input image.

In the second embodiment, a mid-frequency band is divided into three bands. As for three component SF1, SF2, and SF3 corresponding to the three bands, three kernels V1, V2, and V3 each having a number of taps "4×4" are prepared for filter processing of each component. By convoluting these kernels to pixels "(4 lines)×(4 columns)" of the input image, sub-field images of three kinds are generated.

In case of dividing the mid-frequency band into three bands, a filter coefficient used for the three bands is changed based on contents. Concretely, each component of the three bands is partially distributed based on the contents. For example, contents largely having a component SF1, contents largely having a component SF2, and contents largely having a component SF3respectively exist. Accordingly, by changing the filter coefficient based on distribution of the component, filter processing suitable for each contents can be executed.

Furthermore, in the second embodiment, as for a component SF4 having a low-frequency band, a kernel W1 having a number of taps "4×4" is prepared for filter processing of SF4.

By convoluting this kernel to pixels "(4 lines)×(4 columns)" of the input image, a sub-field image is generated. Briefly, a filter coefficient applied to the component SF4 does not change during generation from the first sub-field to the fourth sub-field.

Figure 10:
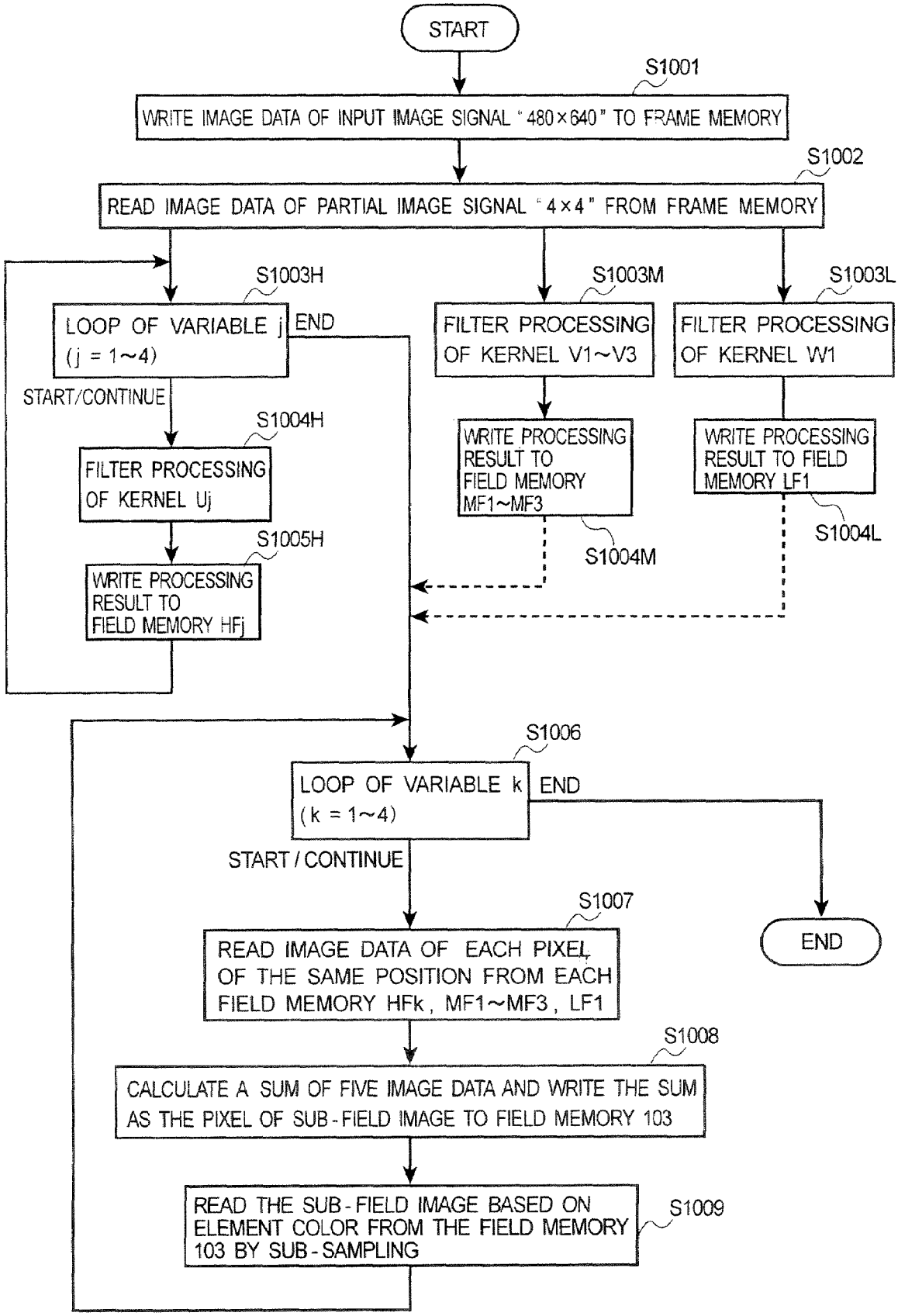
FIG. 10 is a flow chart of an image processing method according to a second embodiment.

FIG. 10 is a flow chart of image processing of a dot matrix type display apparatus of the second embodiment. In FIG. 10, by dividing the input image into five frequency bands, image processing is executed for each component of the five bands. FIG. 10 shows calculation processing of image data (one pixel) for the display apparatus after writing the input image onto a frame memory.

In FIG. 10, each kernel is used for separation processing of spatial frequency. Briefly, steps of the spatial frequency band separation unit 102-1 and each filter processing unit 102-2, 102-3, and 102-4 are realized by filter processing using kernels $U_j$, V1~3, W1. In case of liner-filter processing, separation processing of spatial frequency band is also realized by the filter processing. Accordingly, filter processing of a plurality of kinds can be realized as one filter processing.

First, image data of pixels "(480 lines)×(640 columns)" of the input image are written to the frame memory (S1001). Next, image data of pixels "(4 lines)×(4 columns)" as a part of the input image are read from the frame memory (S1002).

As for a component SF4 of low-frequency band, filter processing by a kernel W1 is executed (S1003L). Processed image data processed are written to a field memory LF1 (S1004L).

As for components SF1, SF2, and SF3 of mid-frequency band, filter processing is executed. For example, filter processing by a kernel V1 is executed to a component SF1; filter processing by a kernel V2 is executed to a component SF2; and filter processing by a kernel V3 is executed to a component SF3 (S1003M). Image data processed from the component SF1 is written to a field memory MF1; image data processed from the component SF2 is written to a field memory MF2; and image data processed from the component SF3 is written to a field memory MF3 (S1004M).

A filter applied to a component SF0 is changed along a time direction. In the second embodiment, four sub-field images are generated. Accordingly, processing from S1004H to S1005H is repeated four times (loop processing). Concretely, as for a variable j, this processing is repeated four times (j=1~4) (S1003H).

By filter processing using a kernel $U_j$ to the component SF0, a component of the j-th sub-field is generated (S1004H) and written to a field memory $HF_j$ (S1005H).

For example, by filter processing using a kernel $U_1$ to the component SF0, a component of the first sub-field is generated (S1004H; j=1) and written to a field memory $HF_1$ (S1005H; j=1). By filter processing using a kernel $U_2$ to the component SF0, a component of the second sub-field is generated (S1004H; j=2) and written to a field memory $HF_2$ (S1005H; j=2). By filter processing using a kernel $U_3$ to the component SF0, a component of the third sub-field is generated (S1004H; j=3) and written to a field memory $HF_3$ (S1005H; j=3). By filter processing using a kernel $U_4$ to the component SF0, a component of the fourth sub-field is generated (S1004H; j=4) and written to a field memory $HF_4$ (S1005H; j=4).

After generation of a component (frequency band) of each of four sub-field images, the re-composition unit 102-5 composes each sub-field image. In the second embodiment, four sub-field images are generated. Accordingly, processing from S1007 to S1009 is repeated as four times (loop processing). Concretely, as for a variable k, this processing is repeated as four times (k=1~4) (S1006).

The re-composition unit 102-5 reads image data of each pixel of the k-th sub-field image from field memories $HF_k$, MF1~3, and LF1 (S1007). The re-composition unit 102-5 calculates a sum of the image data of the same pixel position, and writes the sum as a value of the pixel of the k-th sub-field image to the field memory 103 (S1008). The LED driving circuit 104 reads the image data corresponding to color of a light emitting element of the display unit 105 from the field memory 103, and drives the light emitting element (S1009).

For example, image data of each pixel of the first sub-field image is obtained from field memories HF1, MF1, MF2, MF3 and LF1 (S1007; k=1). A sum of each image data of the same pixel position is calculated, and written as a value of the pixel of the first sub-field image to the field memory 103 (S1008; k=1). The LED driving circuit 104 reads the value of the same color as each light emitting element of the display unit 105 from a corresponding pixel position of the field memory 103, and drives each light emitting element (S1009; k=1).

In image processing of the dot matrix type display apparatus of the second embodiment, sub-sampling is executed after generating all sub-field images. Accordingly, data processing of all pixels "(480 lines)×(640 columns)×(three colors)" is executed. However, actually, it is sufficient that data processing of pixels corresponding to a number of elements "(240 lines)×(320 columns)" of the display apparatus is executed. In this case, by previously indicating the pixel position to be processed, calculation quantity can be reduced.

Figure 11:
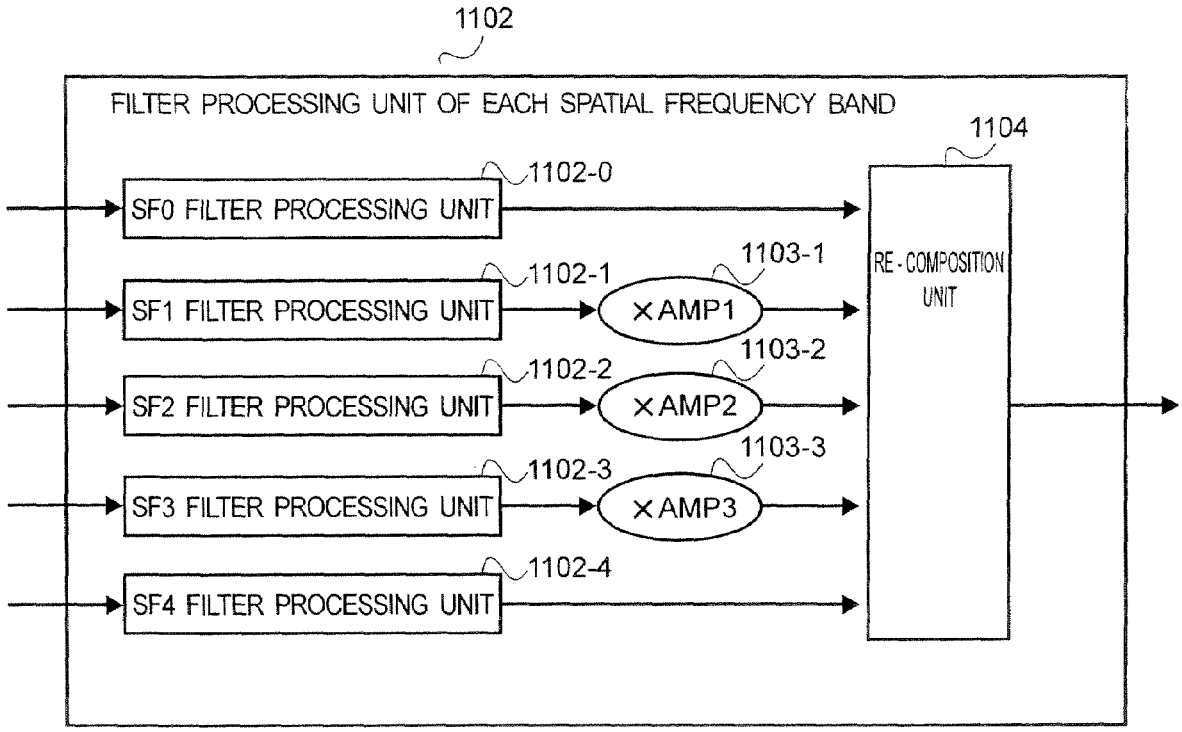
FIG. 11 is a block diagram of the filter processing unit according to a third embodiment.

Next, image generation method of the dot matrix type display apparatus of the third embodiment is explained. FIG. 11 is a block diagram of a filter processing unit 1102 of each spatial frequency band of the third embodiment. The filter processing unit 1102 corresponds to the filter processing unit 102 of the first and second embodiments.

In the third embodiment, the filter processing unit 1102 reads each frame of the input image from the frame memory 101 in FIG. 1. The filter processing unit 1102 generates four sub-field images and writes them to the field memory 103 of FIG. 1.

The filter processing unit 1102 includes a SF0 filter processing unit 1102-0, a SF1 filter processing unit 1102-1, a SF2 filter processing unit 1102-2, a SF3 filter processing unit 1102-3, and a SF4 filter processing unit 1102-4. The SF0 filter processing unit 1102-0 selectively executes filter processing to a component SF0 of high-frequency band. The SF1 filter processing unit 1102-1 selectively executes filter processing to a component SF1 of mid-frequency band. The SF2 filter processing unit 1102-2 selectively executes filter processing to a component SF2 of mid-frequency band. The SF3 filter processing unit 1102-3 selectively executes filter processing to a component SF3 of mid-frequency band. The SF4 filter processing unit 1102-4 selectively executes filter processing to a component SF4 of low-frequency band. In the third embodiment, the component SF1 includes a higher band than the component SF2, and the component SF2 includes a higher band than the component SF3.

These filter processing units executes filter processing to extract a component of predetermined frequency band from the input image and executes filter processing to the component. A component of each frequency band of the sub-field image is generated.

The filter processing unit 1102 includes an amplifier 1103-1, an amplifier 1103-2, and an amplifier 1103-3. The amplifier 1103-1 amplifies output from the SF1 filter processing unit 1102-1 by an amplification rate AMP1. The amplifier 1103-2 amplifies output from the SF2 filter processing unit 1102-2 by an amplification rate AMP2. The amplifier 1103-3 amplifies output from the SF3 filter processing unit 1102-3 by an amplification rate AMP3.

Furthermore, the filter processing unit 1102 includes a re-composition unit 1104. The re-composition unit 1104 calculates a sum of an output from the SF0 filter processing unit 1102-0, an output from the amplifier 1103-1, an output from the amplifier 1103-2, an output from the amplifier 1103-3, and an output from the SF4 filter processing unit 1102-4. The re-composition unit 1104 outputs the sum as a sub-field image to the field memory 103.

As mentioned-above, a filter used for a component of mid-frequency band can change a coefficient based on contents. To raise the visual resolution of an image, an amplification rate of a component of a higher frequency band within the mid-frequency band is increased.

In the third embodiment, the input image is divided into a component SF0 of high-frequency band, three components SF1~SF3 of mid-frequency band, and a component SF4 of low-frequency band. Filter processing (image processing) is executed for each component SF0, SF1, SF2, SF3, and SF4. After filter processing, the amplifiers 1103-1, 1103-2, and 1103-3 respectively amplify components SF1, SF2, and SF3 of mid-frequency band.

The component SF1 has a higher band than the component SF2, and the component SF2 has a higher band than the component SF3. Accordingly, in the third embodiment, AMP2 is set as a larger value than AMP3, and AMP1 is set as a larger value than AMP2. Briefly, a relationship "AMP1>AMP2>AMP3" is maintained. As a result, one component of higher band is relatively emphasized in the mid-frequency band, and a visual resolution in the image rises.

On the other hand, a component SF0 of high-frequency band as an alias component is not amplified. Conversely, in order to suppress the alias, a coefficient to reduce the component SF0 may be multiplied.

The re-composition unit 1104 calculates a sum of all components after filter processing and amplification, and generates a sub-field image. The re-composition unit 1104 integrates a pixel value of the sub-field image. For example, if the sum is 128.5, the sum is integrated as 128 or 129. Briefly, the re-composition unit 1104 rounds, raises, or omits numerals below a decimal point.

Furthermore, if a pixel value is not within a gray level displayable on the dot matrix type display apparatus, the re-composition unit 1104 executes clipping of the pixel value as an upper limit or a lower limit. For example, if the dot matrix type display apparatus can display the gray level "0~255", the re-composition unit 1104 clips the pixel value "257" to "255".

Furthermore, in the re-composition unit 1104, the error diffusion method for gradually propagating a residual can be used. For example, assume that processing begins from the left upper corner of pixels on the image. If a value "257" of some pixel is obtained, a residual caused by clipping is "2" (=257−255). The residual "2" is used for calculation of the next pixel value. For example, the residual is added to a value of the next pixel, or propagated by weighting with neighboring pixels. Concretely, the residual is added by respectively weighting with each value of neighboring pixels.

In the same way, if a residual "−2" of some pixel is obtained, the residual "−2" is used for calculation of the next pixel or neighboring pixels. This effect mainly appears in high-frequency component, and a smoothing effect to suppress the aliasing is obtained.

Next, the image generation method of the dot matrix type display apparatus of the fourth embodiment is explained.

Figure 14:
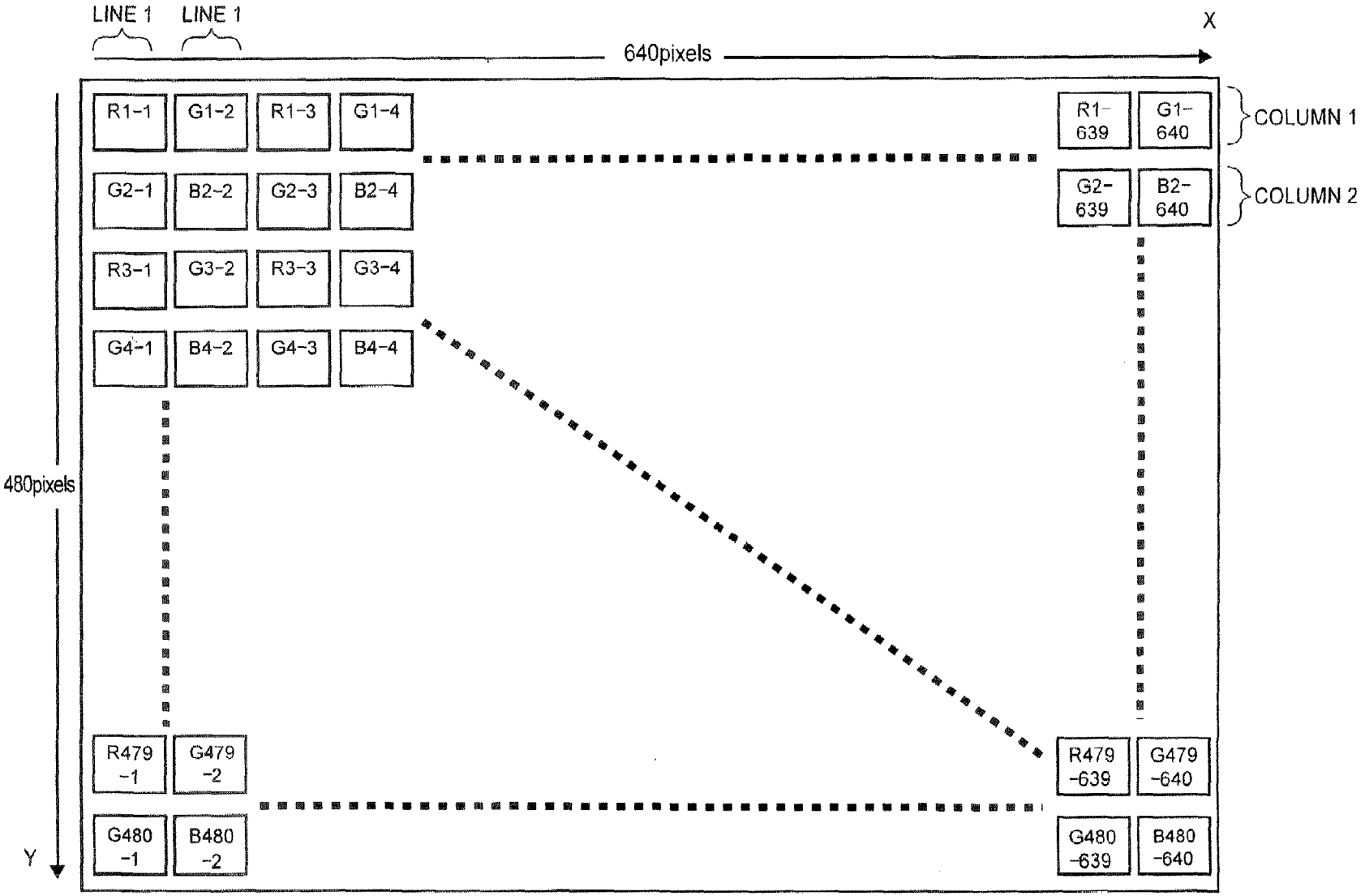
FIG. 14 is a schematic diagram of components of a screen of the dot matrix type display apparatus according to the fourth embodiment and a fifth embodiment.

FIG. 14 shows an arrangement of (light emitting) elements on the dot matrix type display apparatus of the fourth embodiment. The display apparatus has elements of "(480 lines)×(640 columns)". Each element is any of: R element (emitting red (R)), G element (emitting green (G)), and B element (emitting blue (B)). A ratio of the number of R elements, the number of G elements, and the number of B elements is 1:2:1. Briefly, the display apparatus has R elements of "(240×320)", B elements of "(240×320)", and G elements of "(480×320)".

In the display apparatus of the fourth embodiment, G elements are located at "((2n-1)-th line)×(2m-th column)" and "(2n-th line)×((2n-1)-th column)". R elements are located at "((2n-1)-th line)×((2m-1)-th column)". B elements are located at "(2n-th line)×(2m-th column)". In FIG. 14, an element (R1-3) represents an R element located at "(1st line)×(3rd column)". In the same way, an element (G3-2) represents a G element located at "(3rd line)×(2nd column)", and an element (B4-2) represents a B element located at "(4th line)×(2nd column)". Hereinafter, G element located at "((2n-1)-th line)×(2m-th column)" is expressed as element G(2n-1, 2m).

Figure 15:
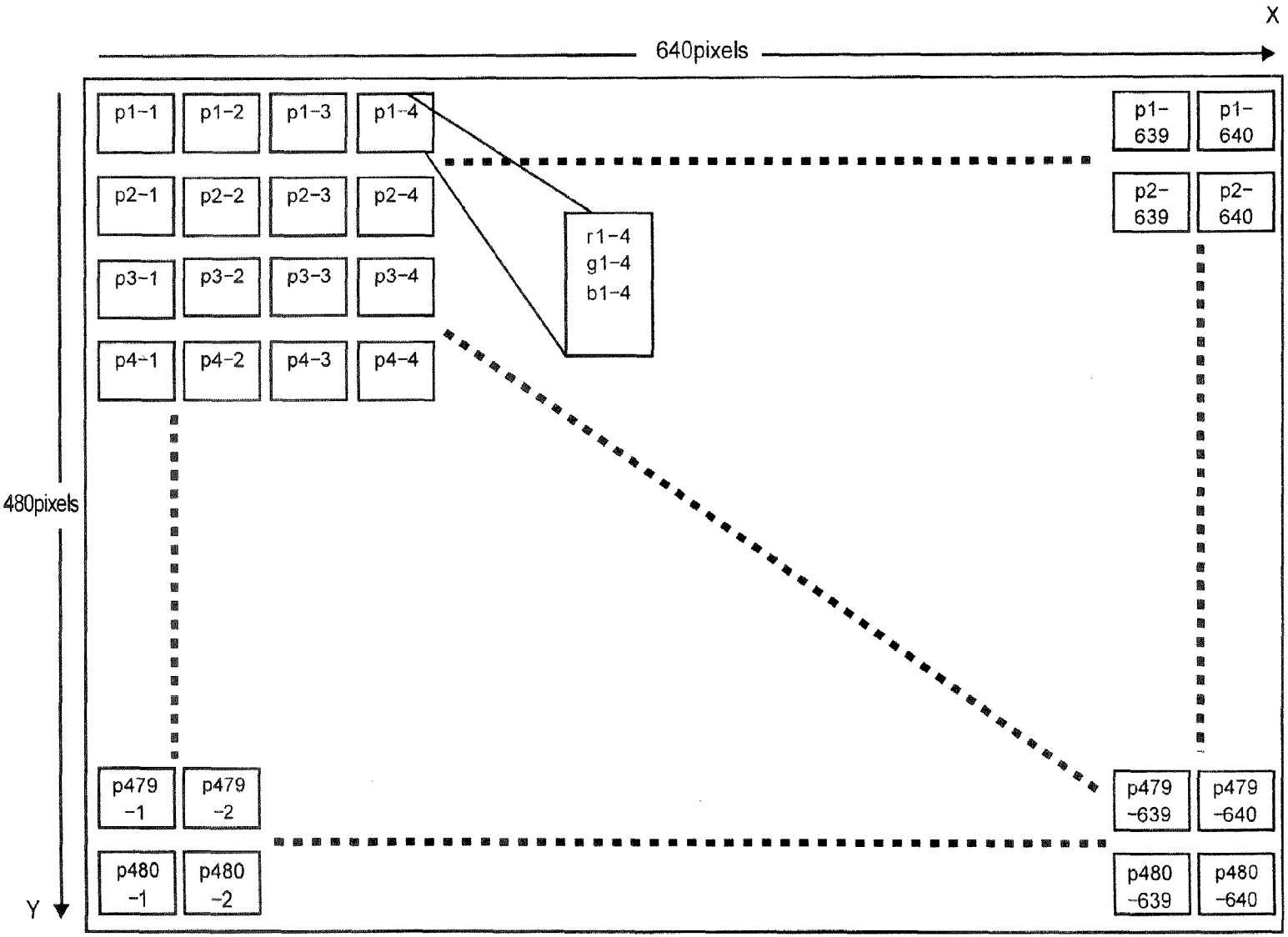
FIG. 15 is a schematic diagram of components of image data to be displayed on the dot matrix type display apparatus according to the fourth embodiment and the fifth embodiment.

FIG. 15 shows an arrangement of pixels on the input image. In the fourth embodiment, the input image is a color image of "(480 lines)×(640 columns)". In FIG. 15, a pixel (p1-4) represents a pixel located at "(1st line)×(4th column)". Each pixel has a pixel value of three colors (red (R), green (G), blue (B)). For example, a pixel (p1-4) has R component (r1-4), G component (g1-4), and B component (b1-4). Accordingly, the input image has pixels of "(480 lines)×(640 columns)" of each color R, G, B.

Figure 12A:
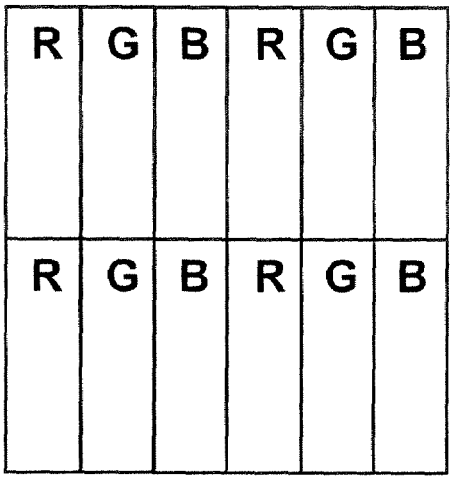
FIGS. 12A and 12B are a schematic diagram of relationship of pixel arrangement between an input image signal and a dot matrix type display apparatus according to a fourth embodiment.
Figure 12B:
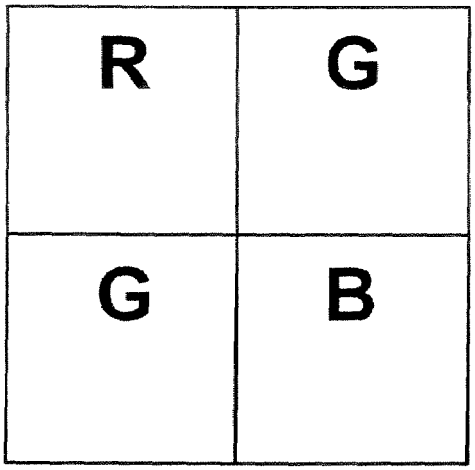

FIGS. 12A and 12B show a relationship between pixels of the input image and elements of the display apparatus. FIG. 12A shows a part "(2 lines)×(2 columns)" of the input image, and FIG. 12B shows a part "(2 lines)×(2 columns)" of the display apparatus. Four pixels (one pixel having R, G, B) in FIG. 12A are displayed as four elements in FIG. 12B.

In the input image of the fourth embodiment, each of pixels "(2 lines)×(2 columns)" has a pixel value of each color (R, G, B). Briefly, one pixel corresponds to three picture elements.

On the other hand, each element of the display apparatus can display only one color of three colors (R, G, B). In the display apparatus of the fourth embodiment, by combining four elements of "(2 lines)×(2 columns)", one color is displayed as mixture of R, G, B components. Briefly, one element of the display apparatus corresponds to one picture element.

In the fourth embodiment, image data of pixels "(2 lines)×(2 columns)" on the input image is converted to image data of one R component, two G components, and one B component. Briefly, a special resolution of R component and B component is respectively reduced to ¼, and a special resolution of G component is reduced to ½. Accordingly, after low-pass filtering of the input image to suppress aliasing, sub-sampling of each color component must be executed.

As for R component and B component, basically, four pixels are sub-sampled as one pixel. Accordingly, a filter having characteristic of FIGS. 4A~4C can be used. The G component has twice the number of elements as the R component and the B component. Accordingly, a filter easier to pass a high-frequency band is used.

Figure 13A:
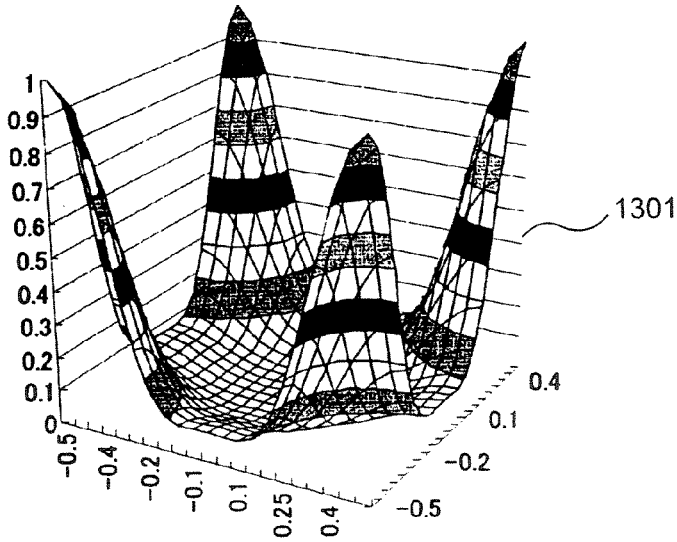
FIGS. 13A, 13B, and 13C are schematic diagrams of characteristics of spatial frequency band extraction filters according to the fourth embodiment.
Figure 13B:
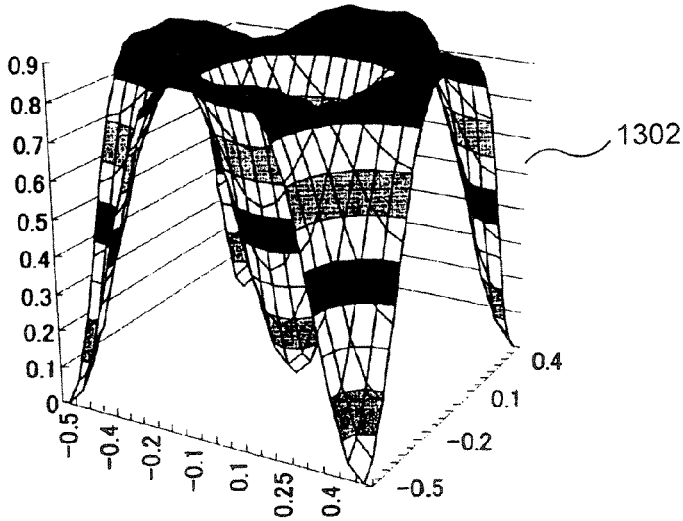
Figure 13C:
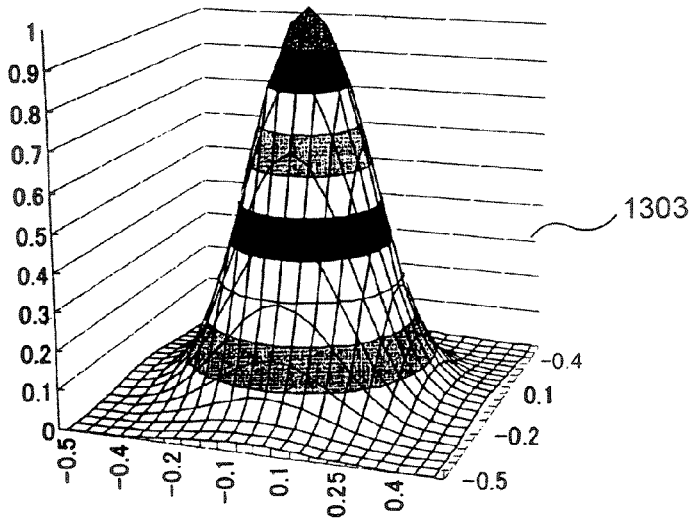

FIGS. 13A~13C show a frequency characteristic of a filter for G component. A frequency characteristic 1301 corresponds to a filter to extract a component of high-frequency band. A frequency characteristic 1302 corresponds to a filter to extract a component of mid-frequency band. A frequency characteristic 1303 corresponds to a filter to extract a component of low-frequency band.

In the dot matrix type display apparatus of the fourth embodiment, G elements are continually distributed along oblique direction as shown in FIG. 12B. Briefly, in comparison with R component and B component, G component along oblique direction is represented by component of high-frequency band. Accordingly, the frequency characteristic 1301 has a characteristic easy to pass a high-frequency band along oblique direction.

As post-processing after separating the image into each spatial frequency band, the same method as the first, second, and third embodiments can be used.

Next, the dot matrix type display apparatus of the fifth embodiment is explained.

FIG. 14 shows an arrangement of elements on the dot matrix type display apparatus. As shown in FIG. 14, a first light emitting element and a second light emitting element are mutually arranged along a first direction (column 1). Hereinafter, this arrangement is called a first light emitting elements column. Furthermore, the second light emitting element and a third light emitting element are mutually arranged along the first direction (column 2). Hereinafter, this arrangement is called a second light emitting elements column. In this case, the first light emitting element and the second light emitting element are mutually arranged along a second direction (line 1) perpendicular to the first direction.

In FIG. 14, the first light emitting element is an R element (R1-1, R1-3, . . . ), the second light emitting element is a G element (G1-2, G1-4, . . . ), and the third light emitting element is a B element (B2-2, B2-4, . . . ). The first direction is column direction (R1-1, G1-2, R1-3, G1-4, . . . ), and the second direction is line direction (R1-1, G2-1, R3-1, G4-1, . . . ). Furthermore, the first light emitting element column is an odd number column, and the second light emitting element column is an even number column.

FIG. 15 shows an arrangement of pixels of the image input to the dot matrix type display apparatus. Each pixel has a first gray level of the first color, a second gray level of the second color, and a third gray level of the third color. In this case, the first color is red, the second color is green, and the third color is blue. Furthermore, in same way as the fourth embodiment, the input image has pixels of "(480 lines)×(640 columns)".

Figure 16:
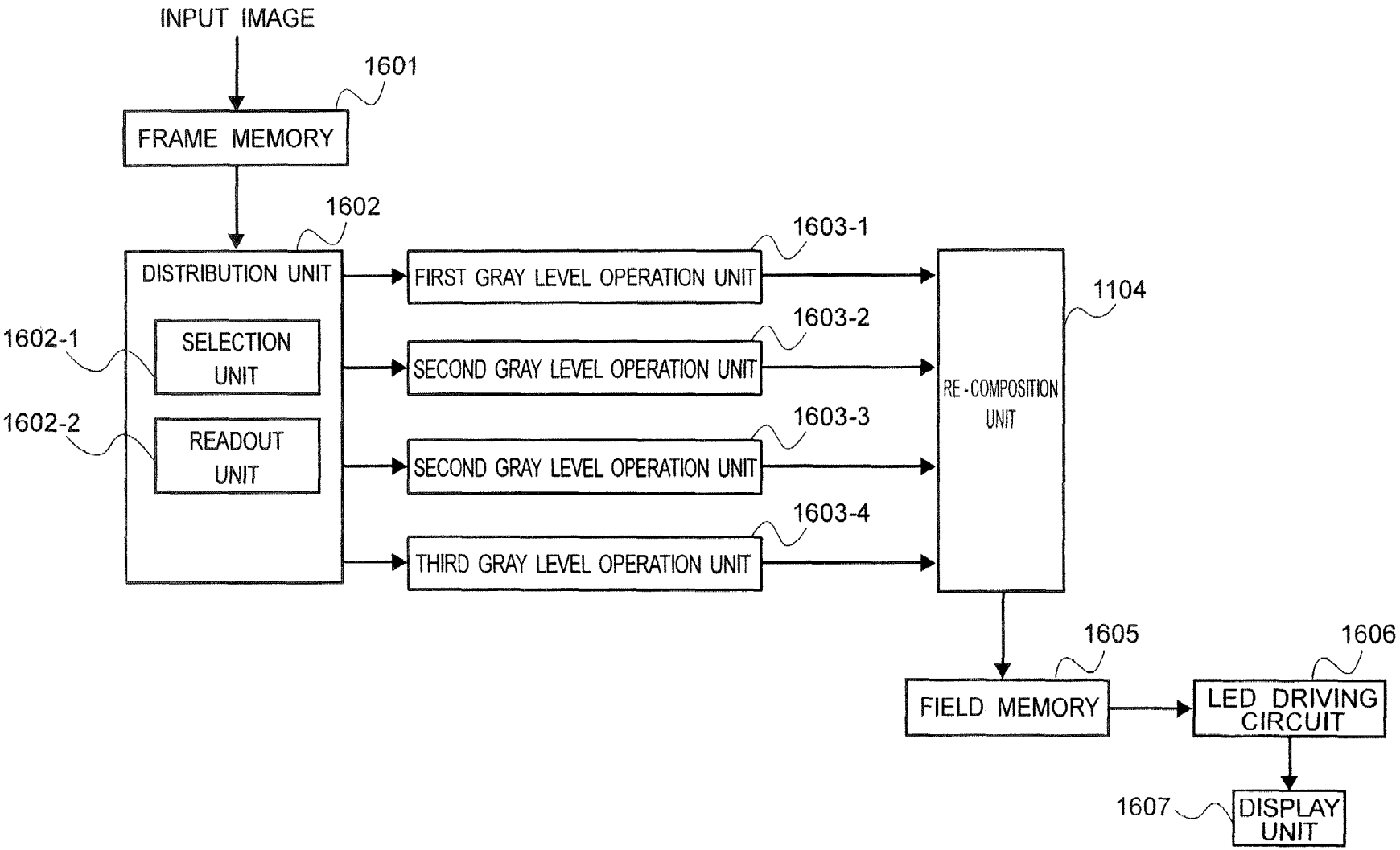
FIG. 16 is a block diagram of the dot matrix type display apparatus according to the fifth embodiment.

FIG. 16 shows a block diagram of the dot matrix type display apparatus of the fifth embodiment. The dot matrix type display apparatus includes a frame memory 1601 to store the image data.

The dot matrix type display apparatus includes a selection unit 1602-1. In the selection unit 1602-1, as for a first pixel corresponding to (same position as) the first emitting element on the input image, four pixels of "(2 lines)×(2 columns)" including the first pixel are selected as first base pixels. In the same way, as for a second pixel corresponding to (same position as) the second emitting element on the input image, four pixels of "(2 lines)×(2 columns)" including the second pixel are selected as second base pixels. As for a third pixel corresponding to (same position as) the third emitting element on the input image, four pixels of "(2 lines)×(2 columns)" including the third pixel are selected as third base pixels.

Furthermore, the dot matrix type display apparatus includes a readout unit 1602-2. The readout unit 1602-2 reads gray level from the frame memory 1601 as follows.

(1) As for each pixel of the first base pixels, the first gray level of a plurality of pixels of "(a lines)×(b columns)" (a>0, b>1, or a>1, b>0) including the pixel is read.

(2) As for each pixel of the second base pixels, the second gray level of a plurality of pixels of "(c lines)×(d columns)" (c>0, d>1, or c>1, d>0) including the pixel is read.

(3) As for each pixel of the third base pixels, the third gray level of a plurality of pixels of "(e lines)×(f columns)" (e>0, f>1, or e>1, f>0) including the pixel is read.

The selection unit 1602-1 and the readout unit 1602-2 are included in a distribution unit 1602. The dot matrix type display apparatus includes a first gray level generation unit 1603-1, second gray level operation units 1603-2 and 1603-3, and a third gray level operation unit 1603-4. Each gray level operation unit correspondingly executes filter processing to the first gray level, two second gray levels, and the third gray level (each read by the readout unit 1602-2), and respectively generates a first light emitting gray level, two second light emitting gray levels, and a third light emitting gray level.

Furthermore, the dot matrix type display apparatus includes a re-composition unit 1104 and a field memory 1605. The re-composition unit 1104 generates each pixel of a field image by combining the first, second, and third light emitting gray levels. The field memory 1605 stores the field image.

Furthermore, the dot matrix type display apparatus includes a LED driving circuit 1606. By using the first, second and third light emitting gray levels of each pixel on the field image, the LED driving circuit 1606 respectively drives the first light emitting element, the second light emitting element, and the third light emitting element of a display unit 1607 during one frame period of the input image.

In FIG. 16, the first gray level is R component, the second gray level is G component, and the third gray level is B component. Accordingly, as for G component, two gray level operation units (the second gray level operation units 1603-2 1603-3) are provided.

In the disclosed embodiments, the processing can be accomplished by a computer-executable program, and this program can be realized in a computer-readable memory device.

In the embodiments, the memory device, such as a magnetic disk, a flexible disk, a hard disk, an optical disk (CD-ROM, CD-R, DVD, and so on), or an optical magnetic disk (MD and so on) can be used to store instructions for causing a processor or a computer to perform the processes described above.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device. The component of the device may be arbitrarily composed.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for displaying an image on a display apparatus of dot matrix type, the image having pixels arranged in ((M lines)×(N columns)), each pixel having color information, the display apparatus having elements arranged in ((P lines)×(Q columns), 1<P<M, 1<Q<N), comprising:

separating the image into a first component and a second component based on a threshold, the first component having a spatial frequency not lower than the threshold, the second component having a spatial frequency lower than the threshold, the threshold being a ratio of the number of the elements to the number of the pixels;

generating a plurality of first display components from the first component by first filter processing using a plurality of filters;

generating a second display component from the second component by second filter processing;

generating a plurality of sub-field images by composing each of the plurality of first display components with the second display component; and driving each element of the display apparatus using the color information of a pixel corresponding to the element in pixels of each of the plurality of sub-field images.

2. The method according to claim 1, wherein each of the plurality of filters has a different filter coefficient, and each of the plurality of first display components is generated from the first component by the first filter processing using each of the plurality of filters.

3. The method according to claim 1, wherein an element of the display apparatus is orderly driven using the same color as the element from the color information of a pixel corresponding to the element and another pixel adjacent to the pixel in pixels of each of the plurality of sub-field images.

4. The method according to claim 1, wherein the second component comprises a plurality of components from a $S_1$ component to a $S_A$ component (1<A), the $S_1$ component having the highest spatial frequency and the $S_A$ component having the lowest spatial frequency in the spatial frequency of the second component;

the second display component comprises a plurality of display components from a $S_1$ display component to a $S_A$ display component by the second filter processing of the plurality of components, the second filter processing including a plurality of filter processing from a $S_1$ filter processing to a $S_A$ filter processing, the $S_1$ filter processing corresponding to the $S_1$ component, the $S_A$ filter processing corresponding to the $S_A$ component, a filter of which coefficient is different along a space direction being differently used in each processing from the $S_1$ filter processing to a $S_B$ filter processing (1<B<A), a filter of which coefficient is same along the space direction being used in each processing from a $S_{B+1}$ filter processing to the $S_A$ filter processing; and the plurality of sub-field images is generated by composing each of the first display components with all of the plurality of display components from the $S_1$ display component to the $S_A$ display component.

5. The method according to claim 4, wherein the number of the plurality of sub-field images is k, the first display component of j-th sub-field image (j≦k) is generated by convolution between a kernel $U_j$ having the number of taps of (a×b, (0<a, 1<b or 1<a, 0<b) ) and the pixels of ((a lines)×(b columns)), each display component from the $S_1$ display component to the $S_B$ display component is generated by convolution between a kernel $V_c$ (c=1, . . . , B) having the number of taps of (a×b) and the pixels of ((a lines)×(b columns)), each display component from the $S_{B+1}$ display component to the $S_A$ display component is generated by convolution between a kernel $W_d$ (d=B+1, . . . , A) having the number of taps of (a×b) and the pixels of ((a lines)×(b columns)), and the j-th sub-field image is generated by composing the first display component of the j-th sub-field image with all display components from the $S_1$ display component to the $S_A$ display component.

6. The method according to claim 4, wherein an amplification rate of a brightness by a $S_h$ filter processing (h=1, . . . , B−1) is larger than an amplification rate of the brightness by a $S_{h+1}$ filter processing.

7. The method according to claim 1, wherein each pixel of the image has three primary colors of red, green, and blue.

8. The method according to claim 1, wherein the display apparatus comprises a plurality of first element lines each having a plurality of first light elements and a plurality of second light elements, a first light element and a second light element being mutually arranged along a first direction, the first light element emitting a first color, the second light element emitting a second color; and a plurality of second element lines each having a plurality of the second light elements and a plurality of third light elements, the second light element and a third light element being mutually arranged along the first direction, the third light element emitting a third color;

the first light element and the second light element are mutually arranged along a direction perpendicular to the first direction.

9. The method according to claim 8, wherein the first color, the second color and the third color are each a different one of red, green, and blue.

10. An apparatus for displaying an image on a display of dot matrix type, the image having pixels arranged in ((M lines)×(N columns)), each pixel having color information, the display having elements arranged in ((P lines)×(Q columns), 1<P<M, 1<Q<N), comprising:

a separation unit configured to separate the image into a first component and a second component based on a threshold, the first component having a spatial frequency not lower than the threshold, the second component having a spatial frequency lower than the threshold, the threshold being a ratio of the number of the elements to the number of the pixels;

a first filter processing unit configured to generate a plurality of first display components from the first component by first filter processing using a plurality of filters;

a second filter processing unit configured to generate a second display component from the second component by second filter processing;

a composition unit configured to generate a plurality of sub-field images by composing each of the plurality of first display components with the second display component; and a driving unit configured to drive each element of the display using the color information of a pixel corresponding to the element in pixels of each of the plurality of sub-field images.

11. The apparatus according to claim 10, wherein each of the plurality of filters has a different filter coefficient, and each of the plurality of first display components is generated from the first component by the first filter processing using each of the plurality of filters.

12. The apparatus according to claim 10, wherein an element of the display is orderly driven using the same color as the element from the color information of a pixel corresponding to the element and another pixel adjacent to the pixel in pixels of each of the plurality of sub-field images.

13. The apparatus according to claim 10, wherein the second component comprises a plurality of components from a $S_1$ component to a $S_A$ component (1<A), the $S_1$ component having the highest spatial frequency and the $S_A$ component having the lowest spatial frequency in the spatial frequency of the second component;

the second display component comprises a plurality of display components from a $S_1$ display component to a $S_A$ display component by the second filter processing of the plurality of components, the second filter processing including a plurality of filter processing from a $S_1$ filter processing to a $S_A$ filter processing, the $S_1$ filter processing corresponding to the $S_1$ component, the $S_A$ filter processing corresponding to the $S_A$ component, a filter of which coefficient is different along a space direction being differently used in each processing from the $S_1$ filter processing to a $S_B$ filter processing (1<B<A), a filter of which coefficient is same along the space direction being used in each processing from a $S_{B+1}$ filter processing to the $S_A$ filter processing; and the plurality of sub-field images is generated by composing each of the first display components with all of the plurality of display components from the $S_1$ display component to the $S_A$ display component.

14. The apparatus according to claim 13, wherein the number of the plurality of sub-field images is k, the first display component of j-th sub-field image ($j \leqq k$) is generated by convolution between a kernel $U_j$ having the number of taps of (a×b, (0<a, 1<b or 1<a, 0<b)) and the pixels of ((a lines)×(b columns)), each display component from the $S_1$ display component to the $S_B$ display component is generated by convolution between a kernel $V_c$ (c=1, . . . , B) having the number of taps of (a×b) and the pixels of ((a lines)×(b columns)), each display component from the $S_{B+1}$ display component to the $S_A$ display component is generated by convolution between a kernel $W_d$ (d=B+1, . . . , A) having the number of taps of (a×b) and the pixels of ((a lines)×(b columns)), and the j-th sub-field image is generated by composing the first display component of the j-th sub-field image with all display components from the $S_1$ display component to the $S_A$ display component.

15. The apparatus according to claim 13, wherein an amplification rate of a brightness by a $S_h$ filter processing (h=1, . . . , B−1) is larger than an amplification rate of the brightness by a $S_{h+1}$ filter processing.

16. The apparatus according to claim 10, wherein each pixel of the image has three primary colors of red, green, and blue.

17. The apparatus according to claim 10, wherein the display comprises a plurality of first element lines each having a plurality of first light elements and a plurality of second light elements, a first light element and a second light element being mutually arranged along a first direction, the first light element emitting a first color, the second light element emitting a second color; and a plurality of second element lines each having a plurality of the second light elements and a plurality of third light elements, the second light element and a third light element being mutually arranged along the first direction, the third light element emitting a third color;

the first light element and the second light element are mutually arranged along a direction perpendicular to the first direction.

18. The apparatus according to claim 17, wherein the first color, the second color, and the third color are each a different one of red, green, and blue.

19. A computer-readable memory device, comprising:

A computer readable program code embodied in said computer-readable memory device for causing a computer to display an image on a display apparatus of dot matrix type, the image having pixels arranged in ((M lines)×(N columns)), each pixel having color information, the display apparatus having elements arranged in ((P lines)×(Q columns) 1<P<M, 1<Q<N), said computer readable program code comprising:

a first program code to separate the image into a first component and a second component based on a threshold, the first component having a spatial frequency not lower than the threshold, the second component having a spatial frequency lower than the threshold, the threshold being a ratio of the number of the elements to the number of the pixels;

a second program code to generate a plurality of first display components from the first component by first filter processing using a plurality of filters;

a third program code to generate a second display component from the second component by second filter processing;

a fourth program code to generate a plurality of sub-field images by composing each of the plurality of first display components with the second display component; and a fifth program code to drive each element of the display apparatus using the color information of a pixel corresponding to the element in pixels of each of the plurality of sub-field images.

* * * * *